US009797079B2

(12) United States Patent
Chappell

(10) Patent No.: US 9,797,079 B2
(45) Date of Patent: Oct. 24, 2017

(54) COLLAPSIBLE WATERTIGHT ASSEMBLY

(71) Applicant: Chappell Solutions Limited, Puckeridge, Ware, Hertfordshire (GB)

(72) Inventor: Ann Chappell, Ware (GB)

( * ) Notice: Subject to any disclaimer, the term of this patent is extended or adjusted under 35 U.S.C. 154(b) by 472 days.

(21) Appl. No.: 14/360,058

(22) PCT Filed: Nov. 22, 2012

(86) PCT No.: PCT/GB2012/000854

§ 371 (c)(1),
(2) Date: May 22, 2014

(87) PCT Pub. No.: WO2013/076443

PCT Pub. Date: May 30, 2013

(65) Prior Publication Data

US 2014/0305174 A1 Oct. 16, 2014

(30) Foreign Application Priority Data

Nov. 22, 2011 (GB) ..... 1120134.0

(51) Int. Cl.
*D06F 95/00* (2006.01)
*D06F 5/02* (2006.01)
*D06F 5/00* (2006.01)

(52) U.S. Cl.
CPC ..... *D06F 5/02* (2013.01); *D06F 5/005* (2013.01); *D06F 95/006* (2013.01)

(58) Field of Classification Search
CPC ..... D06F 95/006
See application file for complete search history.

(56) References Cited

FOREIGN PATENT DOCUMENTS

| | | | |
|---|---|---|---|
| EP | 1676947 | A | 7/2006 |
| GB | 1 598 911 | A | 9/1981 |
| JP | H01 164980 | U | 11/1989 |
| KR | 100 806 880 | B1 | 2/2008 |
| WO | 2005064064 | A | 7/2005 |
| WO | 2012015853 | A | 2/2012 |

OTHER PUBLICATIONS

United Kingdom Intellectual Property Office, Search Report issued in corresponding Application No. GB1120134.0, dated Mar. 9, 2012.

*Primary Examiner* — Jason Ko
(74) *Attorney, Agent, or Firm* — Stites & Harbison, PLLC; David W. Nagle, Jr.

(57) ABSTRACT

A collapsible watertight assembly comprises an impermeable flexible container (1) having an open end adapted to be sealed, a neck (7) closable by a screw cap (8), and a roll and lock seal (9) which provides a watertight seal on the open end. The assembly further comprises a reticulated inner container (11) adapted to fit inside the impermeable container (1). In use, a person puts garments in the inner container (11), places the inner container (11) inside the impermeable flexible container (1), fills the impermeable flexible container (1) with water and a cleaning substance, seals the sealing means (9) and applies an agitating motion to the assembly to enable the garments to be washed. The assembly can be used as a portable laundry assembly, as a self-contained assembly for bleaching, dyeing rinsing and drip-drying clothes or to carry water or to keep items dry in high-humidity or damp conditions.

12 Claims, 2 Drawing Sheets

COLLAPSIBLE WATERTIGHT ASSEMBLY

The present invention relates to a collapsible watertight assembly for use, in particular but not exclusively, as a portable laundry assembly, self-contained receptacle, shower or water carrying receptacle.

Camping enthusiasts, trekkers, hikers, sailors and frequent travellers are often forced to hand wash any garments that they may require. Further, known portable washing systems are inconvenient because they add bulk and weight to a user's luggage. Although, travelling washing powder or soap may be used in facilities provided by a hotel, camping site or vessel this method is often inconvenient and untidy. In addition, it restricts the use of the facilities, for example a sink, to a certain period of time or when not in use by others.

At home, many people find delicate items require hand washing or soiled items such as children sports kits require soaking. Thus, it is not unusual to find people wash or pre-wash items in the bathroom sink, in a tub or in a bucket. Although this is a time-honoured way of washing garments, it is often inconvenient and messy and sometimes rather unsightly.

Further, as some pre-washing or soaking requires the use of whiteners or bleach, users would prefer to be provided with a self-contained device or assembly which prevents any spillage of whiteners or bleach which could damage other garments or surfaces. A self-contained solution could be used to dye garments without staining surfaces, other garments or the washing machine.

The embodiments of the present invention aim to provide a collapsible watertight assembly suitable for use as a portable laundry assembly for camping enthusiasts, trekkers, hikers, frequent travellers or sailors and also for general purpose hand washing or soaking. In addition, it provides a self-contained assembly for bleaching, dyeing rinsing and drip-drying clothes. Moreover, the assembly of the present invention can be used to carry water or to keep items dry in high-humidity or damp conditions.

According to a first aspect of the present invention, there is provided a collapsible watertight assembly comprising: an impermeable flexible container having an open end adapted to be sealed, an inlet or outlet port closable by a cap, and sealing means to provide a watertight seal on the open end; the collapsible watertight assembly further comprising a reticulated inner container, which reticulated container is adapted to fit inside the impermeable flexible container; the reticulated inner container being adapted to receive items to be washed, wherein, in use, the impermeable flexible container is supplied with water and a cleaning substance, the said open end is sealed by the sealing means, and the port is closed by said cap, to enable the assembly to be agitated to thereby clean the said items.

The embodiments of the present invention allow a user to wash garments using a predetermined amount of water. As a result, the water use may be controlled and it is possible to use less water than that used by other hand-washing or soaking methods, particularly when washing only a small number of small items, which is environmentally advantageous. In addition, it allows the user to save money.

Further, embodiments of the present invention make facilities available for their intended uses. In addition, the assembly is watertight so the user is kept substantially dry; this is an advantage over known methods which generally require a user to become at least partially wet.

Moreover, an embodiment of the present invention is foldable and very light; as a result, it does not add bulk or weight to a user's luggage and it can be easily stored at home.

Additionally, an embodiment of the present invention allows a user to control disposal of detergent or water mixed with detergent, which means a user can choose to dispose of used or soapy water in an environmentally-friendly manner.

Advantageously, the reticulated container is further adapted to be held in place by the sealing means. In use, this feature increases the cleaning action on the fabric fibres because the reticulated bag provides a very mildly abrasive surface which cleans the garments. Further, this feature allows items to be drip-dried inside the exterior bag in a self-contained manner.

In a preferred embodiment, the reticulated container has a semi-rigid reticulated base. This allows the reticulated container to retain its shape to a certain extent so that, in use, the reticulated bag will not subside; thus, the garments contained within the bag will have space to allow the fibres to be washed properly.

Advantageously, the collapsible water receptacle further has a handle to facilitate handling and shaking of the assembly when in use. More advantageously, the impermeable flexible container has a reinforced base. This feature increases structural integrity of the assembly and thus makes it more resilient. Preferably, the handle is welded to the reinforced base. The combination of these features enhances durability and manoeuvrability.

In an alternative embodiment, the impermeable flexible container has a textured inner surface. This feature boosts cleaning action on the garments by providing a mildly abrasive surface.

Preferably, the impermeable flexible container is made from a synthetic plastic. More preferably, the synthetic plastic is polyvinyl chloride, vinyl, polyethylene or polypropylene. This feature enables the assembly to be manufactured easily and cheaply.

Advantageously the impermeable flexible container has a thickness 0.5 mm. This feature allows a user to use water at a hotter temperature than that tolerated by bare hands.

Preferably, the reticulated container is made from nylon mesh. This feature enables the reticulated container to be manufactured easily and cheaply.

In a preferred embodiment, the cap has a diameter of 4 cm and is attached to the assembly by means of a string, a plastic ring or any other substantially flat attachment means. This enables the cap to remain attached to the assembly even when it is not secured to the neck, as a result, a user is much less likely to damage or lose the cap.

The present invention will now be described with reference to an exemplary embodiment shown in the accompanying drawings, in which.

Figure 1:
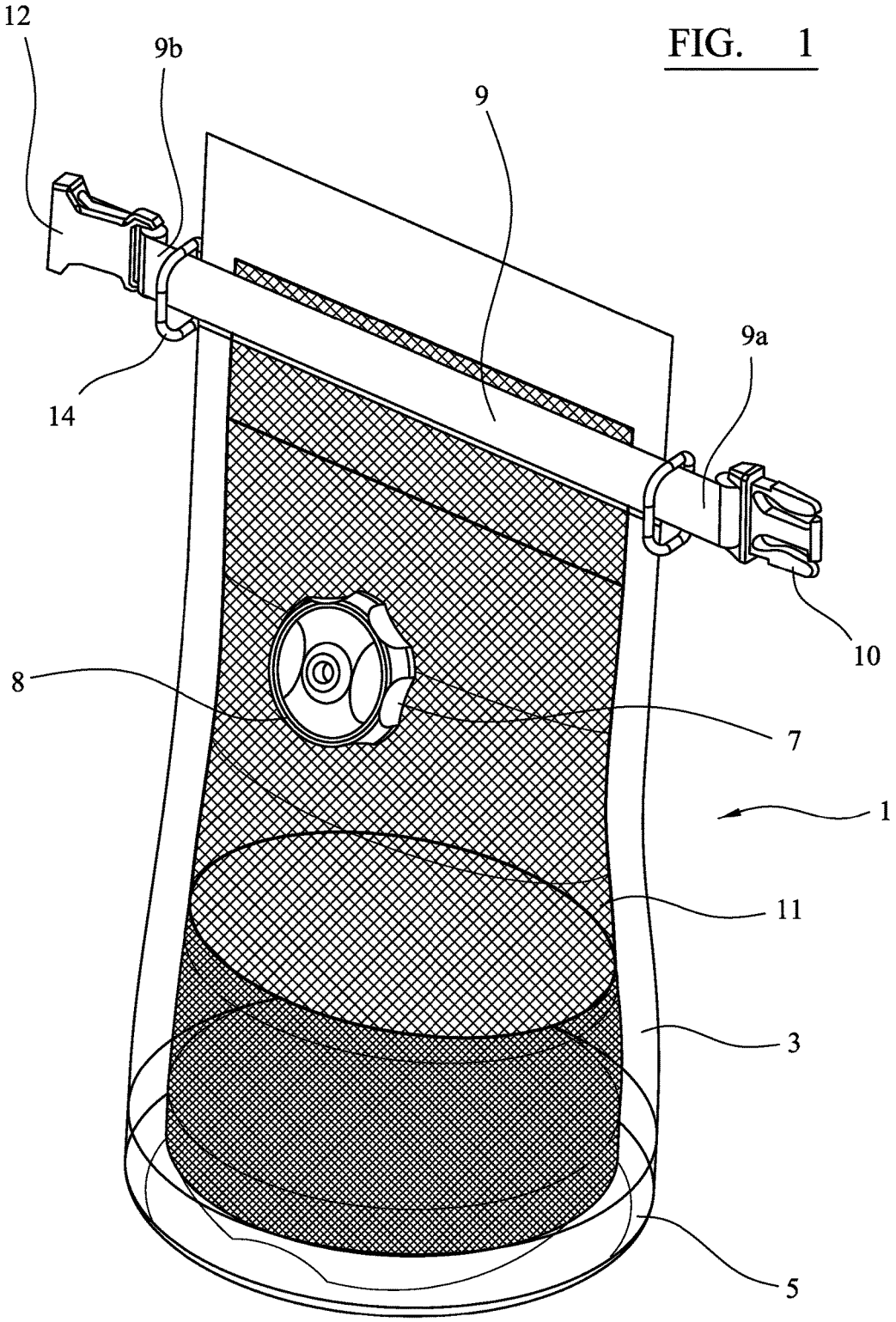
FIG. 1 is a perspective view of this embodiment of the present invention.

Referring now to FIG. 1, there is shown a substantially cylindrical collapsible water container 1 made of a synthetic plastic, such as vinyl. The container 1 has a clear portion 3 and a reinforced base 5 which will be described in detail with relation to FIG. 2 below. In this embodiment, the vinyl has a thickness of 0.5 mm which enables the container to be fold easily but in addition, provides sufficient thermal insulation so that a user may fill the bag with hot water. The clear portion comprises a threaded opening 7 configured to receive a cap 8 which allows a user to fill or empty the container. In this example, the neck and cap have a diameter of 4 cm which allows the container to be filled and emptied easily. A string (not shown) is used to attach the cap to the neck to prevent loss.

At one end the container is open and has at a point remote from its open a band of plastics material 9 which forms a natural fold line and which assists the user to fold the bag over to form an efficient watertight seal 9; the band has an overhanging portion 9*a*, 9*b* on each side. Each overhanging portion ends in a side release buckle part or webbing clip part, 10 and 12. In this embodiment, the clips are 25 mm webbing clips. In addition, a 25 mm webbing D ring 14 is attached to each overhanging portion 9*a*, 9*b* at the end remote to that which is attached to the clip parts 10, 12. The assembly is sealed by "roll & seal" means. Thus, in use, a person would fold the bag over at the point marked by the band 9; fold over this first fold twice and then secure the seal by fastening the side clips 10, 12 to form an efficient watertight seal.

A reticulated bag or container 11 is placed inside the water container 1 so that in use, garments may be placed inside it and, during agitation; the reticulated structure 11 applies a gentle force on the garments to clean them. In addition, the reticulations help the cleaning substance to foam. The internal bag 11 is approximately 5% smaller than the external container 1 to achieve an appropriate fit. The reticulations provide a mildly abrasive surface which contributes to removal of dirt from the garment fibres. This, in combination with the use of soapy water allows clothes to be washed efficiently.

In use, a person would place garments in the internal reticulated bag 11, fill the water container 1 with water through the opening 7 or the open end, add soap or other cleaning material, fold the container 1 at the marked point, then fold over the first fold once or twice or more and finally fasten the side clips 10, 12.

Figure 2:
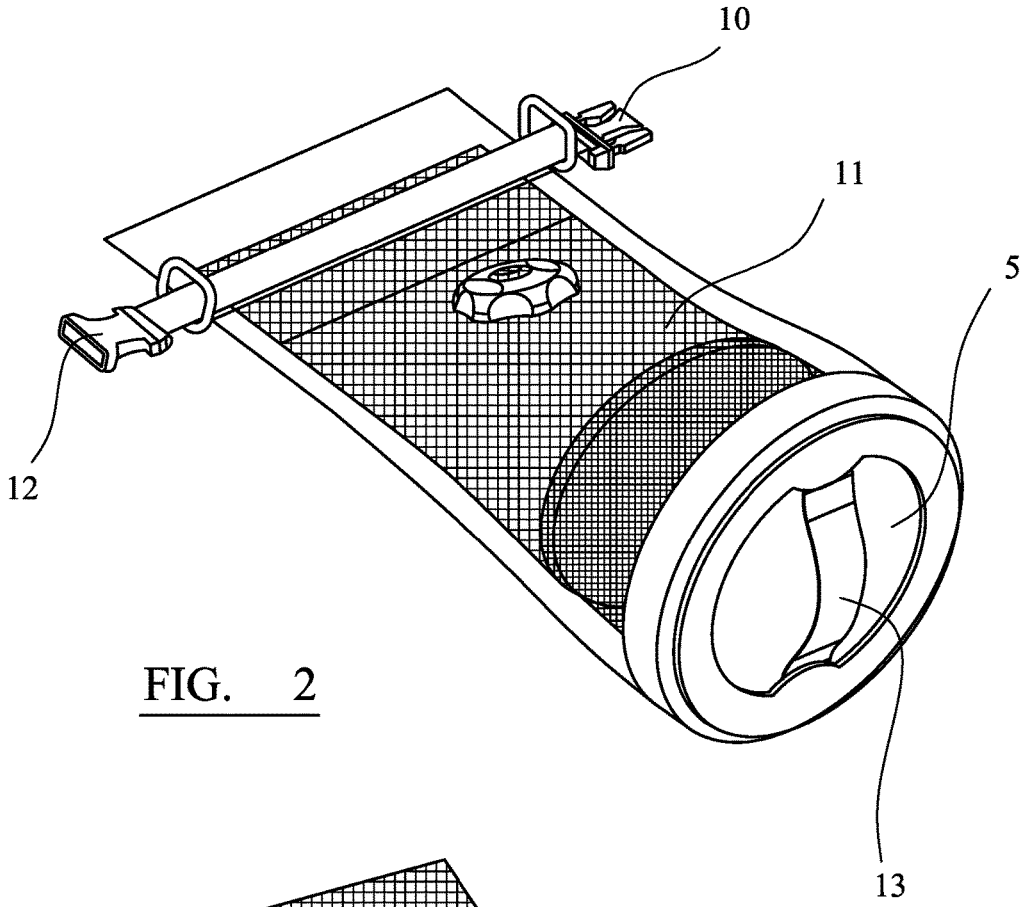
FIG. 2 is an underside perspective view of the embodiment shown in FIG. 1.

FIG. 2 shows the underside of the reinforced base 5 of the water container 1. The reinforced base is also made from vinyl but it has a reinforced light textured weave instead of a smooth finish as the clear portion 3. The underside of the reinforced base 5 comprises a handle 13 to allow a user to grip the assembly at the bottom. The assembly may also be held by the handle formed by the seal and the clips 10, 12 at the top so that it can be gripped with both hands and shaken, moved or otherwise agitated to allow the soapy water contained therein to penetrate the fabrics to remove dirt. The handle 13 is welded to the reinforced base 5. An additional ring of webbing material is welded over the ends of the handle so that the handle is secured firmly on the reinforced base 5.

Figure 3:
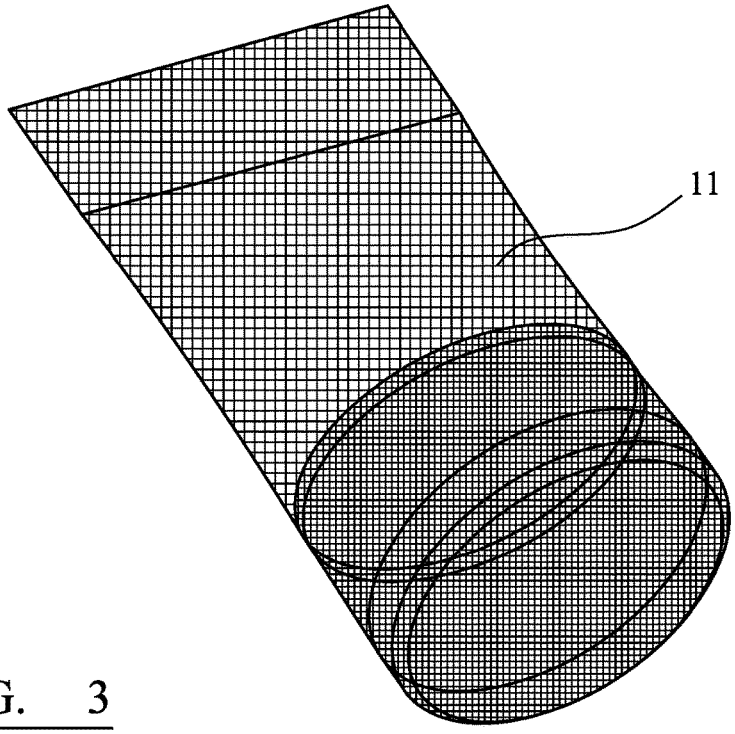
FIG. 3 is an underside perspective view of a reticulated container used in the embodiment shown in FIGS. 1 and 2.

Referring now to FIG. 3, there is shown the reticulated bag 11 used in this embodiment which is made of a synthetic plastic, such as nylon mesh. In this embodiment, the bag 11 is made from two types of nylon mesh and is substantially cylindrical so that it can be placed within the impermeable flexible container 1 and comprises a reticulated base and a cylindrical wall. The base and bottom part of the cylindrical wall are made of slightly more rigid material than that used for the top portion of the cylindrical wall (soft mesh) to allow the bag to stand when the assembly is in use. However, the more rigid mesh is flexible enough to be folded when the assembly is in the collapsed position. This rigid lower portion ensures the reticulated bag 11 does not collapse in use. A band of material secures the rigid portion of the cylindrical wall to the soft portion of the wall. Thus, a predetermined amount of interior space is guaranteed and, as a result, the garment fibres have sufficient exposure to soapy water.

When a user has washed the garments for a suitable time, the cap can be unscrewed and the liquid contents of the container disposed of in a convenient way into a suitable outlet point. The reticulated bag 11 can be retained in the impermeable container to allow the garments to drip within the container to prevent untidiness. Alternatively, a user may take the reticulated bag 11 out of the flexible container 1 and allow the garments to drip in controlled fashion. Further, it will be appreciated that a user may have several reticulated bags which can be used for different purposes.

In an alternative embodiment, not shown, the flexible container 1 has a textured inner surface which acts as a mild abrasive and increases water turbulence, therefore, it contributes to the cleaning of the garments.

Although a vinyl external container 1 has been described, different plastics materials such as polyvinyl chloride, polyethylene or polypropylene, may also be used. Further, different thicknesses of material may also be used.

In addition to the laundry use described above, the watertight container and or assembly may be used as a self-contained unit to bleach or dye clothes so that other surfaces are not decoloured or stained. Moreover, the watertight container and or assembly may be used to rinse garments such as swimming costumes worn in a chlorinated pool; to drip dry garments or to avoid wetting items inside the bag. Further, the container and or assembly may be used to separate wet, damp or dirty items from other items.

The container and or assembly can also be used to carry water or to provide a water reservoir, which can be used, for example, as a camping shower. As the container comprises a threaded neck, a suitable threaded shower adaptor may also be provided. Additionally, the neck and cap may have a different diameter. Furthermore, the cap may be attached to the neck by a plastic O ring, string, wire or other suitable flexible attachment means.

It will be apparent to those skilled in the art that the invention may be provided in different sizes tailored to specific uses. For example, a 3I or a 5I assembly may be provided for hand-washing delicate items, such as lingerie, at home; while a 101 would be more appropriate for washing garments during a camping trip.

The invention claimed is:

1. A collapsible watertight assembly, comprising:

an impermeable flexible container having an open end adapted to be sealed and a port closable by a cap;

a sealing means to provide a watertight seal at the open end of the impermeable flexible container; and a mesh container adapted to fit inside the impermeable flexible container;

said mesh container further being adapted to receive items to be washed, wherein, in use, the impermeable flexible container is supplied with water and a cleaning substance, the open end is sealed by the sealing means, and the port is closed by the cap to enable the assembly to be agitated by a user to thereby clean the items;

wherein the impermeable flexible container has a reinforced base and a handle that is welded to the reinforced base.

2. The collapsible watertight assembly of claim 1, wherein the mesh container is further adapted to be held in place by the sealing means.

3. The collapsible watertight assembly of claim 1, wherein the mesh container has a base and a generally cylindrical wall, wherein the base and a bottom portion of the generally cylindrical wall are made from a more rigid material than a top portion of the generally cylindrical wall.

4. The collapsible watertight assembly of claim 1, wherein the impermeable flexible container has a textured inner surface.

5. The collapsible watertight assembly of claim 1, wherein the impermeable flexible container is made from synthetic plastic.

6. The collapsible watertight assembly of claim 5, wherein the mesh container is made from nylon mesh.

7. The collapsible watertight assembly of claim 5, wherein the synthetic plastic is selected from the group consisting of polyvinyl chloride, vinyl, polyethylene, or polypropylene.

8. The collapsible watertight assembly of claim 1, wherein the impermeable flexible container has a thickness of about 0.5 mm.

9. The collapsible watertight assembly of claim 1, wherein the cap has a diameter of about 4 cm.

10. The collapsible watertight assembly of claim 1, wherein the cap is attached to the assembly by means of a string or a plastic ring.

11. The collapsible watertight assembly of claim 1, wherein the collapsible watertight assembly is adapted to provide a portable shower, the collapsible watertight assembly further comprising a shower head adapted to be secured to said port on the impermeable flexible container in place of said cap.

12. A collapsible watertight assembly, comprising:

an impermeable flexible container having an open end adapted to be sealed, a port closable by a cap, and a reinforced base which includes a handle;

a sealing means to provide a watertight seal at the open end of the impermeable flexible container; and a mesh container adapted to fit inside the impermeable flexible container, wherein, in use, the mesh container receives items to be washed and is positioned inside the impermeable flexible container, the impermeable flexible container is supplied with water and a cleaning substance, with the open end sealed by the sealing means and the port closed by the cap, such that the assembly can be agitated by a user by grasping the handle to clean the items received in the mesh container within the impermeable flexible container.

* * * * *